United States Patent [19]

Korsgaard

[11] Patent Number: 4,567,080

[45] Date of Patent: Jan. 28, 1986

[54] VAPOR BARRIER

[75] Inventor: Vagn Korsgaard, Hørsholm, Denmark

[73] Assignee: V.I.K.-Consult ApS, Hørsholm, Denmark

[21] Appl. No.: 711,582

[22] PCT Filed: Jun. 19, 1984

[86] PCT No.: PCT/DK84/00056

§ 371 Date: Feb. 20, 1985

§ 102(e) Date: Feb. 20, 1985

[87] PCT Pub. No.: WO85/00188

PCT Pub. Date: Jan. 17, 1985

[30] Foreign Application Priority Data

Jun. 20, 1983 [DK] Denmark ..... 2840/83
Dec. 7, 1983 [DK] Denmark ..... 5634/83

[51] Int. Cl.[4] ..... B32B 3/10

[52] U.S. Cl. ..... 428/137; 428/316.6; 428/913

[58] Field of Search ..... 428/137, 138, 316.6, 428/913

[56] References Cited

U.S. PATENT DOCUMENTS 3,253,598 5/1966 Spanel ..... 428/137
3,881,489 5/1975 Hartwell ..... 428/137

*Primary Examiner*—William J. Van Balen
*Attorney, Agent, or Firm*—Watson, Cole, Grindle & Watson

[57] ABSTRACT

A vapor barrier comprises two vapor-tight layers (1,2) and a water absorbing layer (3) interposed therebetween. Openings (5,6) are provided in both vapor-tight layers (1,2). The openings in one layer (1) are arranged in displaced positions relatively to the openings (6) in the other layer (2). The vapor barrier offers a high resistance to the diffusion of water vapor through the vapor barrier from one side towards the other, and enables condensed water formed on the other side of the vapor barrier to travel in the opposite direction and to be evaporated from the first mentioned side.

8 Claims, 4 Drawing Figures

Figure 1:
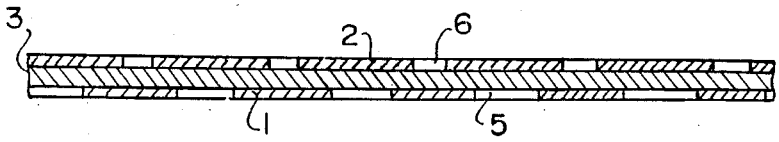

FIG. 3
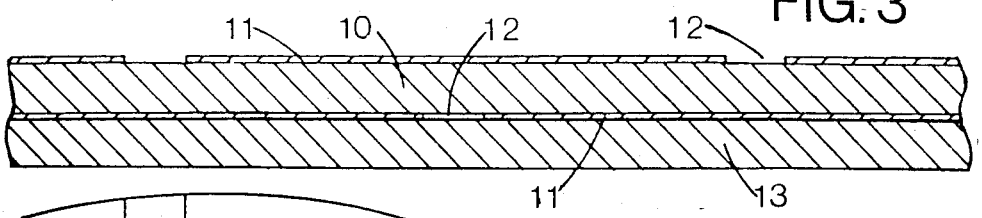
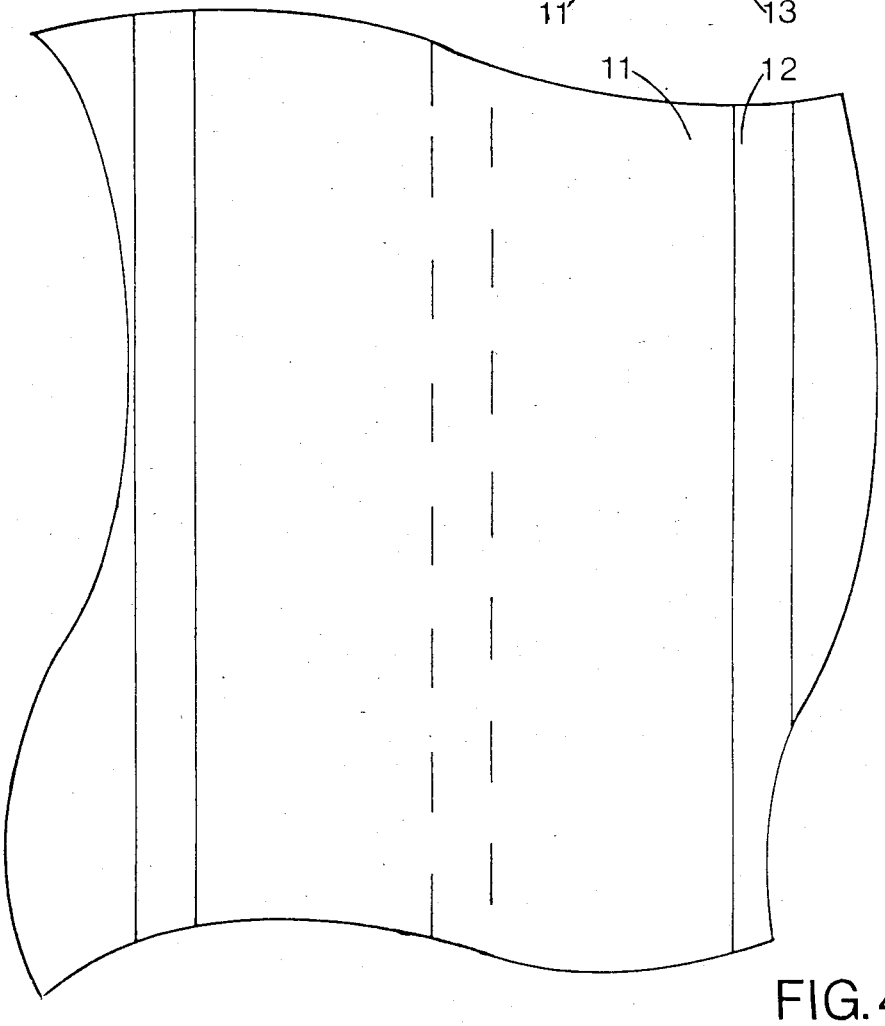
FIG. 4

VAPOR BARRIER

The invention relates to a vapour barrier comprising a layer of a vapour-tight (vapour impervious) material connected with a layer of water absorbing material, openings permitting the passage of vapour and water being provided in the layer of vapour-tight material.

The invention is chiefly directed to a vapour barrier for use in connection with roof constructions comprising a vapour-tight outer covering.

In roof construction with such a vapour-tight outer covering, e.g. one or more layers of roofing felt, when the outer temperature drops, a condensation of water vapour and thereby an accumulation of moisture may take place on the underside of the outer covering, unless special precautions are taken to avoid that moisture saturated air gets into contact with the underside of the cold outer covering.

In roof constructions comprising cavities wholly or partly filled with a layer of porous heat insulating material, a vapour-tight foil is frequently interposed between the layer of heat insulating material and the underside of the roof construction, e.g. a ceiling lining, in order to prevent an accumulation of moisture in the zone between the ceiling lining and the outer covering. However, it is impossible in practice to prevent the occurrence of leakages in such a vapour-tight foil, through which leakages moisture loaded air penetrates into the zone between the vapour-tight foil and the outer covering.

To remove the moisture penetrating through the vapour-tight foil, the Danish building regulations prescribe that roof constructions of the kind described should be ventilated. In the case of smaller roof areas this requirement can normally be fulfilled by providing ventilation openings in the roof overhang, which openings communicate with the interior of the roof construction.

To obtain a suitable ventilation of larger roof areas it will usually be necessary to mount ventilating means, such as ventilating hoods, which are connected with the interior of the roof construction.

When using ventilating hoods for the venting of roof constructions in which the roof covering is completely airtight, such as a roofing felt covering, the flow of air, and thereby the flow of moisture through the leakages of the vapour-tight foil will be considerably increased, and the ventilation hoods may in such cases strongly aggravate the moisture problems rather than alleviating them.

In the Danish patent specification No. 87,317 there is disclosed a covering for application to the inner side of walls consisting of a water and a vapour impervious material, such as a ship's side or a wall of an airplane, the said covering consisting of a layer of heat insulting material applied to the inner side of the ship's side or airplane wall and being provided on its inner side with a perforated water vapour arresting layer, wicks being provided in the perforations of the water vapour arresting layer. These wicks serve to conduct condensed water formed in the interspace between the ship's side or the airplane wall and the perforated water and vapour arresting layer out of the said interspace and into a moisture distributing layer applied to the inner side of the water and vapour arresting layer and from which it can be removed by evaporation.

If a covering of the above mentioned type were used as a vapour barrier in a roof construction having a watertight outer covering, it would offer a too small resistance to diffusion of water vapour to prevent that the amount of moisture, which in the cold part of the year diffuses through the water and vapour arresting layer and is condensed in the zone between this layer and the vapour-tight roof covering, will exceed the critical value for rot and fungal attack, and to prevent dripping before the moisture is evaporated when the accumulated moisture is driven out of the interspace between the two layers during the hot part of the year.

It is the object of the invention to provide a vapour barrier of the kind mentioned in the introduction, which offers a sufficiently high resistance to diffusion of water vapour from one side of the vapour barrier towards the other to prevent an unacceptably high accumulation of moisture on the other side of the vapour barrier, and which enables condensed water formed on the other side of the vapour barrier to move in the opposite direction and to be evaporated from the first named side.

This object is achieved by the vapour barrier according to the invention, the distinctive feature of which is that it comprises two vapour-tight layers and a water absorbing layer disposed therebetween, openings being provided in both vapour-tight layers, the openings in one layer being arranged in displaced positions relatively to the openings in the other layer.

The two vapour-tight layers may consist of perforated plastics foils. The holes may have circular shape, and the holes in one of the layers is preferably larger than the holes in the other. The holes in one of the layers, which is preferably disposed interiorly, have e.g. a diameter of 20–30 mm, while the diameter of the holes in the other (exterior) layer is e.g. about 5 mm. Since the resistance to diffusion of vapour through the vapour barrier according to this embodiment of the invention depends on the logarithm of the ratio of the diameter of a circle having its center in the center of one of the small holes and tangentially touching the periphery of the larger holes, to the diameter of the smaller holes, as well as on the thickness of the water absorbing layer arranged between the two vapour-tight layers, it will be understood that by suitably selecting the said parameters vapour barriers can be obtained which satisfy varying needs and uses.

The openings in the two layers need not be circular. Thus, in a preferred embodiment they are linear and are produced by attaching parallel strips of a vapour-tight foil, e.g. strips of a polyolefine foil, on both sides of a layer of water absorbing material in such a manner that non-covered small interspaces are left between the marginal edges of the strips. If strips of equal width, b, are used on both sides of the layer of water absorbing material, the strips on one side of the layer are preferably displaced by b/2 relative to the strips on the opposite side of the layer. Hereby the vapour diffusion resistance offered by the water absorbing material is utilized in the best possible way, and at the same time maximum security is obtained that moisture that may be accumulated in the layer is drained off in periods, where the moisture is driven in a direction towards the inner side of the vapour barrier.

The water absorbing layer in the vapour barrier according to the invention consists preferably of a porous material consisting of or containing natural or modified cellulose fibers. Such a water absorbing layer has a relatively high water absorption capacity and is easily available in varying thicknesses and with varying porosity.

The water absorbing layer is preferably impregnated with a fungicide to prevent a tendency to fungoid growth in the layer and a spread of such fungi to the outer side of the vapour barrier.

As an example of a suitable water absorbing material for interposition between the two vapour arresting layers reference can be made to a cellulose fiber layer having a thickness of 1 mm and having absorption properties like blotting paper.

In a preferred embodiment of the vapour barrier according to the invention, this further comprises a water absorbing layer which is arranged in contact with the outer side of one of the vapour-tight layers. The further water absorbing layer may be composed in the same manner as the layer disposed between the two vapour-tight layers and may, like that layer, be impregnated with a fungicide.

When such a vapour barrier is employed in a roof or wall construction, it is placed in such a manner that the water absorbing layer, which is in contact with the outer side of one of the vapour-tight layers, is located on the inner side of the vapour barrier and may thus serve to absorb water which during the hot part of the year is forced from the opposite side of the vapour barrier or from the interspace between the two vapour-tight layers into the water absorbing layer on the inner side of the vapour barrier.

The water absorption capacity of the inner water absorbing layer should be so high that it can absorb all the amount of moisture thus driven out without giving rise to dripping before the water is evaporated.

The vapour barrier according to the invention is preferably produced in sheet form by feeding forward a sheet of the water absorbing material e.g. in the form of a glass fiber fleece- or felt-like material or a rot resistant paper, and by continuously extruding thin foils of a thermoplastic material, such as polyethylene, directly onto the surfaces of the sheet of the water absorbing material. For the extrusion wide nozzles are used, in which blinds are arranged having a width corresponding to the width of the desired non-coated zones on the surfaces of the said sheet.

When the extruded foils leave the nozzles, they have e.g. a temperature of 300° C. and are sticky. Thereby an efficient adhesion to the water absorbing sheet material can be obtained.

The sheet coated in the manner described can then be passed to a set of calender/cooling rollers and can upon cooling be rolled up to form rolls e.g. jumbo-rolls, meaning rolls having a sheet length of e.g. 600 m.

It may be desirable to make the marginal zones on one side of the sheet material self-adhesive in order to facilitate the joining of two or more sheets by overlapping. The formation of the self-adhesive marginal zones may take place in connection with a conversion of jumbo-rolls to commercial rolls having a sheet length of about 25 m, set-off rollers being used for the purpose.

In order to avoid a sticking-together in the marginal zones, strips of silicone paper may be applied to the self-adhesive marginal zones before the rolling-up into commercial rolls takes place.

The vapour barrier according to the invention is particularly suitable for use in a roof construction comprising a vapour-tight outer covering. An example of such a roof construction is a construction built up from cases which as their upper supporting layer have a plywood plate which on its upper side has an adhesively applied covering consisting of one or more layers of roofing felt. The inner space of such cases can be filled with an insulating material, e.g. mineral wool, and the bottom consists e.g. of a wood wool concrete slab which at the same time constitutes the ceiling lining. When such cases are provided with a vapour barrier according to the invention, this is preferably arranged on the upper side of the wood wool concrete slab.

The vapour barrier according to the invention can, however, also be used for interior supplemental insulation of outer walls. Ordinarily, an interior supplemental insulation is made by setting up a lath frame on the inner side of the wall and placing mineral wool mats between the laths, whereafter a cover plate is nailed to the laths. Even if a completely vapour-tight membrane is arranged between the mineral wool insulating layer and the cover plate, moisture problems may occur in such a construction as a consequence of the fact that moisture absorbed in the outer wall e.g. due to heavy rain will under the influence of solar heat during the hot part of the year be driven inwards through the wall and the insulating layer and will be condensed on the outer side of the vapour-tight membrane. Such a condensation of water vapour, which may in particularly grave cases have the effect that condensed water trickles down along the outer side of the membrane and out on the floor, and may in other cases have the effect that both insulation and laths become moist and are attacked by rot and fungi, can be avoided by using the vapour barrier according to the invention, which does not entrap any condensed water, but enables it to penetrate into the water absorbing layer on the inner side of the vapour barrier and to be evaporated therefrom.

The vapour barrier can also be used to prevent the accumulation of condensed water on the inner side of walls of water and vapour impervious materials other than roofing felt, such as ship's sides and airplane walls made from metal plates.

The water absorbing layer disposed between the two vapour impervious layers serves during the cold part of the year to increase the resistance to diffusion of water vapour in a direction towards the outer side of the vapour barrier, and to absorb water which during the hot part of the year is forced in the opposite direction.

In practice the said strips can have a width of at least 10 cm and the non-covered areas a width of less than 10 cm.

Figure 2:
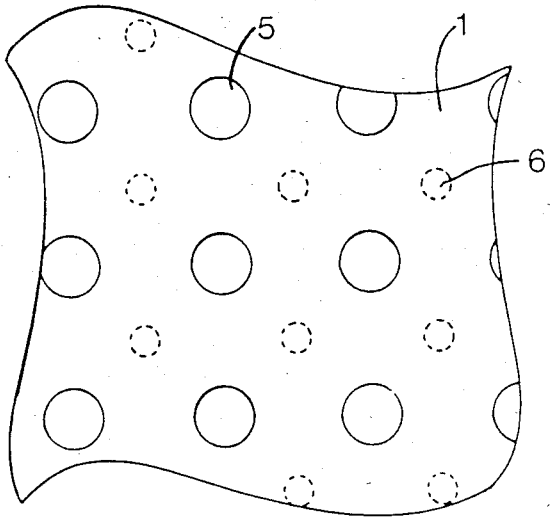

The invention will now be further described with reference to the drawings, in which FIG. 1 shows a diagrammatic cross section of one embodiment of the vapour barrier according to the invention, FIG. 2 shows the vapour barrier of FIG. 1 as seen from above, FIG. 3 shows a diagrammatic cross section of another embodiment of the vapour barrier according to the invention, and FIG. 4 shows the vapour barrier of FIG. 3 as seen from below.

The vapour barrier illustrated in FIG. 1 is composed of two perforated vapour-tight foils 1 and 2, between which a layer of water absorbing material 3 is interposed. In the foil 1 circular holes 5 having a relatively great diameter, $d_1$, are provided. The holes are arranged in rows at equidistant spacing. In the layer 2 holes 6 having a relatively small diameter, $d_2$, are provided.

These are located in the zone between four holes 5 and at the same distance from each hole.

The embodiment of the vapour barrier according to the invention illustrated in FIGS. 3 and 4 comprises a layer of water absorbing material, e.g. consisting of a water absorbing glass fiber fleece- or felt-like material or a rot resistant paper having a weight of about 100 $g/m^2$, said layer being coated on both sides with strips 11 of a vapour-tight foil. The strips 11, which may e.g. have a width of 28 cm and may consist of polyethylene foil having a weight of 40 $g/m^2$, are arranged in such a manner that non-coated spaces 12 are formed between adjacent edges of the strips. In the embodiment shown, the spaces 12 have the same width, e.g. 8 cm, on both sides of the layer 10, whereby the diffusion path through the glass fiber material will be about 10 cm.

The vapour barrier illustrated comprises a further layer 13 of water absorbing material. The layer 13 is connected with one of the vapour arresting layers formed by the strips 11.

I claim:

1. Vapour barrier comprising a layer of a vapour-tight (vapour impervious) material connected with a layer of water absorbing material, openings permitting the passage of vapour and water being provided in the layer of vapour-tight material, characterized in that it comprises two vapour-tight layers (1,2;11) and a water absorbing layer (3,10) disposed therebetween, openings (5,6;12) being provided in both vapour-tight layers (1,2;11), the openings (5,12) in one layer (1,11) being arranged in displaced positions relatively to the openings (6,12) in the other layer (2,11).

2. Vapour barrier according to claim 1, characterized in that it further comprises a water absorbing layer (13) arranged in contact with the outer surface of one of the vapour-tight layers (11).

3. Vapour barrier according to claim 1, characterized in that the water absorbing layers (3; 10,13) consist of or contain natural or modified cellulose fibers.

4. Vapour barrier according to claim 1, characterized in that the water absorbing layers (3; 10,13) are impregnated with a fungicide.

5. Vapour barrier according to claim 1, characterized in that the vapour-tight layers (1,2) consist of perforated plastics foils.

6. Vapour barrier according to claim 5, characterized in that the perforations in one of the vapour-tight layers (2) are smaller than the perforations in the other vapour-tight layer (1).

7. Vapour barrier according to claim 1, characterized in that the vapour-tight layers consist of strips (11) of a vapour-tight foil, which strips are arranged with narrow interspaces (12) therebetween.

8. Vapour barrier according to claim 7, characterized in that the vapour-tight layers consist of strips (11) of equal width, b, and the strips on one side of the layer (3,10) of water absorbing material are displaced by b/2 relatively to the strips on the opposite side of the layer.

* * * * *